United States Patent [19]

Kanamaru et al.

[11] 4,290,295

[45] Sep. 22, 1981

[54] METHOD OF MAKING V-GROOVED PULLEY ASSEMBLY

[75] Inventors: Hisanobu Kanamaru; Hideo Tatsumi; Akira Tohkairin; Kosaku Sayo, all of Ibaraki, Japan

[73] Assignee: Hitachi, Ltd., Tokyo, Japan

[21] Appl. No.: 68,563

[22] Filed: Aug. 22, 1979

[30] Foreign Application Priority Data

Aug. 23, 1978 [JP] Japan ..... 53-103314

[51] Int. Cl.[3] ..... B21D 22/00

[52] U.S. Cl. ..... 72/356; 29/159 R; 474/171; 474/174

[58] Field of Search ..... 72/356, 352, 343; 74/230.8; 113/116 D; 29/159 R

[56] References Cited

U.S. PATENT DOCUMENTS

| | | | |
|---|---|---|---|
| 3,225,425 | 12/1965 | Skinner et al. | 29/159 R |
| 3,242,559 | 3/1966 | Olsen | 29/159 R |
| 3,851,366 | 12/1974 | Jacobs | 29/159 R |
| 3,933,023 | 1/1976 | Tatsumi et al. | 72/359 |
| 4,004,335 | 1/1977 | Pierce et al. | 29/159 R |
| 4,023,250 | 5/1977 | Sproue | 29/159 R |

*Primary Examiner*—Leon Gilden

*Attorney, Agent, or Firm*—Craig & Antonelli

[57] ABSTRACT

A V-grooved pulley assembly having thick wall portion and thin wall portion therein designed for use with electromagnetic type clutches for driving air conditioning compressors on automobiles and the like wherein the component parts thereof are fabricated by cold workings so as to result in a reduction of the cost of materials and labor.

7 Claims, 8 Drawing Figures

METHOD OF MAKING V-GROOVED PULLEY ASSEMBLY

BACKGROUND OF THE INVENTION

This invention relates generally to a new method of making V-grooved pulley assembly having wall portions of different thicknesses so as to reduce the cost of materials and labor.

A V-grooved pulley assembly is normally used with electric clutches for transmitting on power of engine mounted in vehicles such as, for example, automobiles and trucks to air conditioner compressors to drive the same.

A preferable V-grooved pulley assembly is provided with a thick wall portion for the structual strength and a magnetically efficient joint which includes thin wall portions for the weight reduction.

A known V-grooved pulley assembly having portions of different thicknesses have been made by means of hot forging workings and machinings.

Problems of the known assembly are that the forging workings themselves are relatively expensive, the cost of machining same even more so, and the combination of the forging workings with the machinings reduces the operation efficiency.

To solve the above-noted problems another method has been proposed in U.S. Pat. No. 3,851,366, wherein V-belt pulley is formed from a single sheet of metal by means of bend-press workings.

Disadvantages of the known V-belt pulley structures formed from the single sheet of metal by means of bend-press working resides in the fact that the number of steps of working processes is increased and the integrity of the pulley structure is low due to the uniform thickness in any portion of the pulley structures.

SUMMARY OF THE INVENTION

An object of the present invention resides in providing a new method of making a V-grooved pulley assembly which reduces the cost of materials and labor.

Another object of the present invention resides in providing a new method of making a V-grooved pulley assembly having wall portions of different thickness with simplicity.

Still another object of the present invention resides in providing a new method of making a V-grooved pulley assembly having a high structural integrity and is of less weight than similar pulleys manufactured from castings or forgings.

In accordance with the present invention, the V-grooved pulley is made by forming a thick wall portion including one side wall portion of the pulley assembly and a tubular thin wall portion which extends from the thick portion and includes the other side wall portion of the pulley assembly from a tubular member by means of cold working, and expanding the tubular thin portion in order to form a V-shaped groove of the pulley assembly.

By virtue of the method of the present invention the cost of materials and labor are reduced since the V-grooved pulley assembly can be manufactured through cold-working processes.

DESCRIPTION OF THE PREFERRED EMBODIMENT

Figure 1:
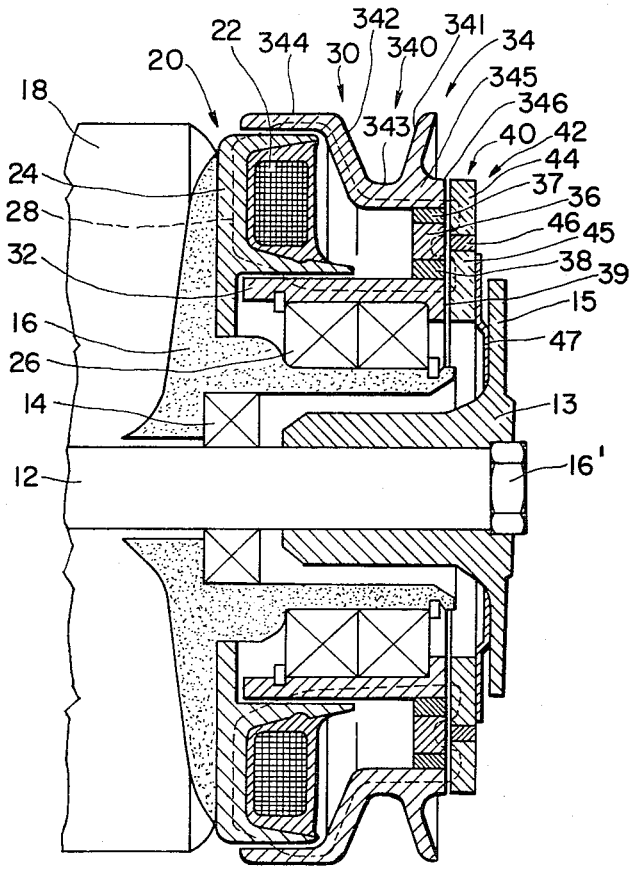
FIG. 1 is a cross-sectional view of a V-grooved pulley assembly according to the present invention mounted on an electromagnetic clutch assembly.

As shown in FIG. 1, FIG. 1 a V-grooved pulley assembly generally designated by the reference numeral 34, fabricated in accordance with the present invention and fashioned from a material having low magnetic reluctance in order to permit the establishment of magnetic fields therein, is mounted on an electric clutch pulley assembly which includes an electromagnetic coil assembly generally designated by the reference numeral 20, a rotor assembly generally designated by the reference numeral 30 and an armature assembly generally designated by the reference numeral 40. A power shaft 12 of a compressor 18 extends into the electric clutch pulley assembly and is rotatably supported by means of a bearing assembly 14. A side cover 16 of the compressor 18 is mounted on the bearing assembly 14.

A shaft boss 13, having a flange portion 15, is fixedly mounted on one end portion of the power shaft 12. The shaft boss 13 is held on the power shaft 12 by a suitable lock nut 16' provided at one end of the power shaft 12.

The electromagnetic coil assembly 20 includes an electromagnetic coil 22 and a casing 24, constructed of a material having a low magnetic reluctance, connected with the side cover 16 of the compressor 18. The electromagnetic coil assembly 20 is energized, in a manner well known by those skilled in the art, whenever a vehicle engine is in operation and when so energized generates a magnetic field that extends from the casing 24. A pair of bearing assemblies 26 for rotatably supporting the rotor assembly 30 are mounted on the side cover 16.

The rotor assembly 30 includes a rotor boss 32, the V-grooved pulley assembly 34 and a disc plate 36 arranged between the rotor boss 32 and the V-grooved pulley assembly 34 through metal members 37 and 38 made of non-magnetic materials.

The V-grooved pulley assembly 34 is adapted to be drivingly connected to the vehicle engine by a pulley belt, not shown, and the V-grooved pulley assembly 34, together with the armature assembly 40, forms part of the clutch mechanism.

The V-grooved pulley assembly 34 is rotatably mounted on the side cover 16 of the compressor 18 by the bearing assembly 26 in fixed axially spaced relationship to the armature assembly 40 in order to form an axial air gap 39 there-between.

The V-grooved pulley assembly 34 includes a V-grooved portion generally designated by the reference numeral 340 including a first and a second side portion 341 and 342, a bottom portion 343, a cylindrical portion 344, extending from the second portion 342 and a disc portion 345 including a friction end face 346. The cylindrical portion 344, the second side portion 342 and the disc portion 345 form a part of a flux path 28 when the electromagnetic coil assembly 20 is energized.

The armature assembly 40 includes an armature disc portion generally designated by the reference numeral 42 axially displaceable into engagement with the friction end face 346 of the V-grooved pulley assembly 34 by the electromagnetic coil assembly 20.

The armature disc portion 42 includes first and second disc plates 44 and 45 made of magnetic materials and a metal portion 46, made of a non-magnetic material, arranged therebetween. The armature disc portion 42 is supported through a leaf spring 47 fitted to the flange portion 15 of the shaft boss 13.

When the electromagnetic assembly 20 is energized a magnetic field, characterized by the flux path 28, extends through the material of the components of the V-grooved pulley assembly 34 and through the armature disc portion 42.

When flex is not present, i.e., the electromagnets are not energized, the armature disc portion 42, as shown in FIG. 1, is separated by a gap 39 from the friction end face 345 of the V-grooved pulley assembly 34. Obviously, once the electromagnets are energized and flux path 28 occurs, a magnetic circuit is built up through the casing 24, the cylindrical portion 344, the second side portion 342, the bottom portion 343, the disc portion 345, first disc portion 44 of the armature assembly 40, the disc plate 36 of the V-grooved pulley assembly 34, second disc portion 45 of the armature assembly 40, and the rotor boss 32, whereby the armature disc portion 42 will be in firm frictional contact with the friction end face 346 of the V-grooved pulley assembly 34 and gap 39 is closed.

The new and improved V-grooved pulley assembly according to this invention will now be described.

Figure 2A:
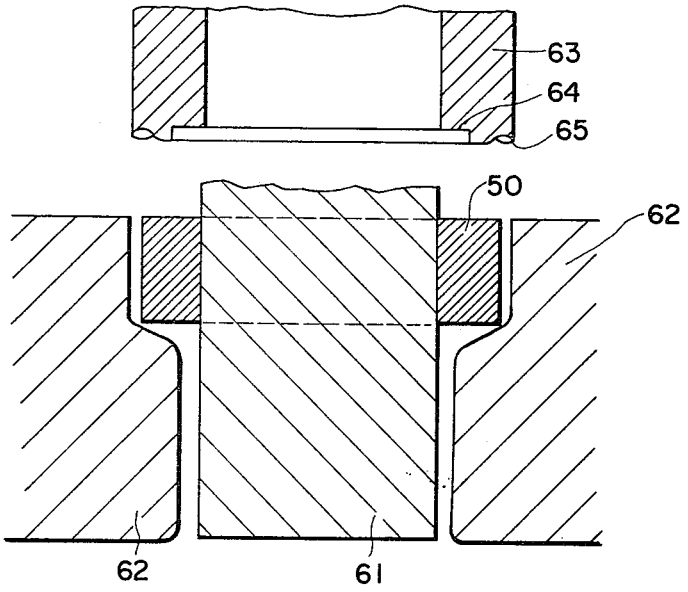
FIG. 2A is a cross sectional view of the tubular metal member and a die arrangement prior to a working in accordance with the method of the present invention.

As shown in FIG. 2A, a die member 61 is inserted into a tubular metal member 50 made of soft iron, with a die ring 62 being arranged around the tubular metal member 50, and a die tubular member 63 arranged above the tubular metal member 50. The tubular die member 63 has a flat face 64 and a curved face 65 one end portion thereof for defining a thick wall portion and a thin wall portion of the V-grooved pulley assembly.

The die member 61 is used for defining an inner side of the V-grooved pulley assembly 34, the die ring 62 is used for defining an outer side of the V-grooved pulley assembly 34, and the tubular die member 63 is used as a punching means for defining the thick wall portion including first side portion 341 of the V-grooved pulley assembly 34, and the tubular thin wall portion including second side portion 342 of the V-grooved pulley assembly 34.

Figure 2B:
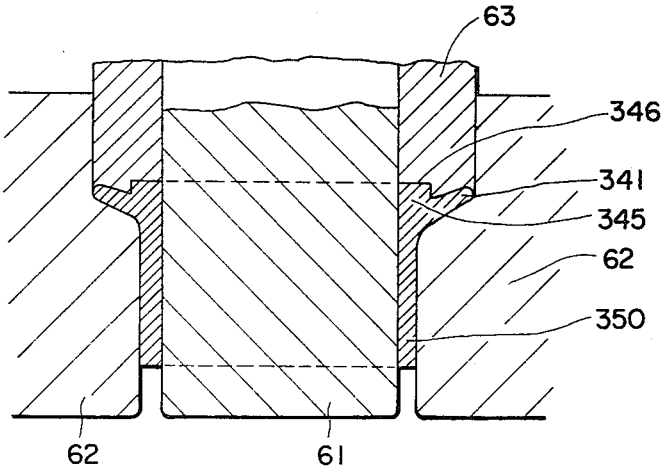
FIG. 2B is a cross-sectional view of the tubular member and die arrangement of FIG. 2A after a forward extrusion working stroke.

After the arrangement of the die members 61, 62 and 63 and the tubular metal member 50 as described above, a forward extrusion working stroke is carried out by means of the tubular die member 63 and, as shown in FIG. 2B, during the foward extrusion working stroke, the thick wall portion comprising disc portion 345 is formed in order to make a good strong and magnetically efficient joint, and the thin wall portion comprising the first side wall portion 341 of the V-grooved pulley assembly 34 is formed at the upper end portion of the tubular metal member 50. The tubular thin wall portion 350 extending from the thick wall portion 345 of the V-grooved pulley assembly 34 is simultaneously formed at a lower end portion of the tubular metal member 50.

Figure 2C:
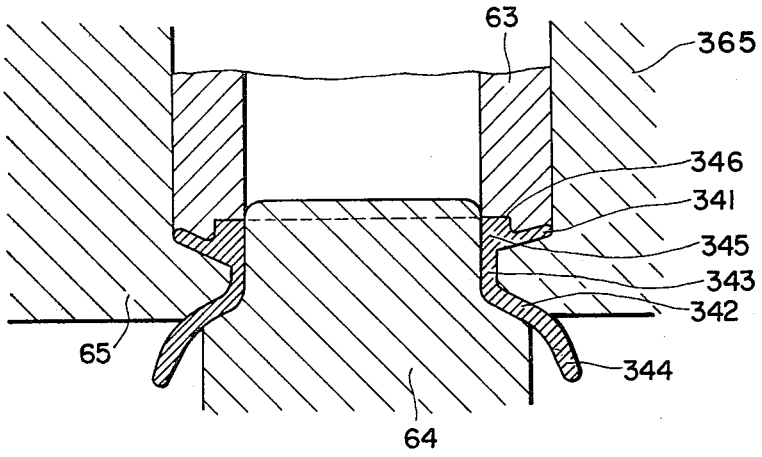
FIG. 2C is a cross sectional view of the tubular member and another die arrangement for expanding a tubular thin portion outwardly to form a V-groove of the V-grooved pulley assembly.

In order to expand the tubular thin wall portion 350 outwardly, as shown in FIG. 2C, the die member 61 and the die ring 62 are removed from the die arrangement of FIGS. 2A and 2B and a new die member 64 and die ring 65 are substituted therefore to further work the tubular metal member 50. The die member 64 has a stepped diameter and functions as a punching means for defining an inner side of the V-grooved pulley assembly 34, while the die ring 65 is used for defining an outer side of the V-grooved pulley assembly 34.

As shown in FIG. 2C, the die member 64 is inserted into the tubular thin wall portion 350 from a lower end and by virtue of the cooperation between the die member 64 and die ring 65 the thin tubular wall portion 350 is expanded to form the V-groove of the V-grooved pulley assembly 34.

The tubular thin wall portion 350 is outwardly expanded by the stepped diameter of the die member 64 so that the second side portion 342 and the bottom portion 343 of the V-grooved pulley assembly 34 is formed.

Figure 2D:
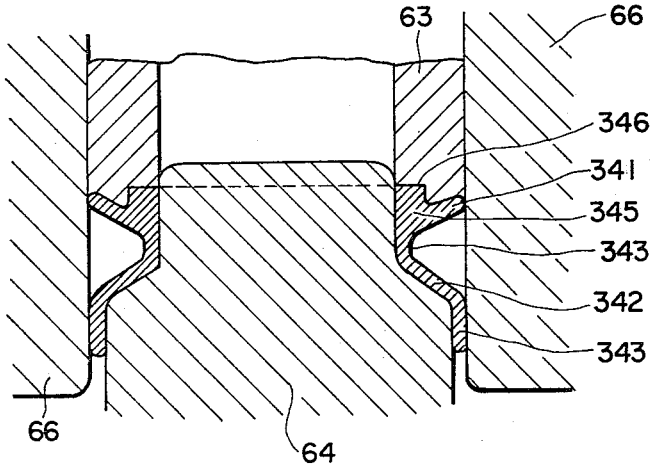
FIG. 2D is a cross sectional view of the tubular member and a further die arrangement for forming a cylindrical portion of the V-groove pulley assembly.

Subsequent to the outward expanding of the tubular thin wall portion 350 to form the V-groove, the die ring 65 is removed from the die arrangement and replaced by a new die ring 66 for forming the cylindrical portion 344 and an angle between the first and second side portions 341,342 of the V-grooved pulley assembly 34. As shown in FIG. 2D, the tubular thin wall portion 350 expanded outwardly in the expanding step (FIG. 2C) is inwardly pressed by the die ring 66 whereby the thin cylindrical portion 344 of the V-grooved pulley assembly is formed.

Figure 3:
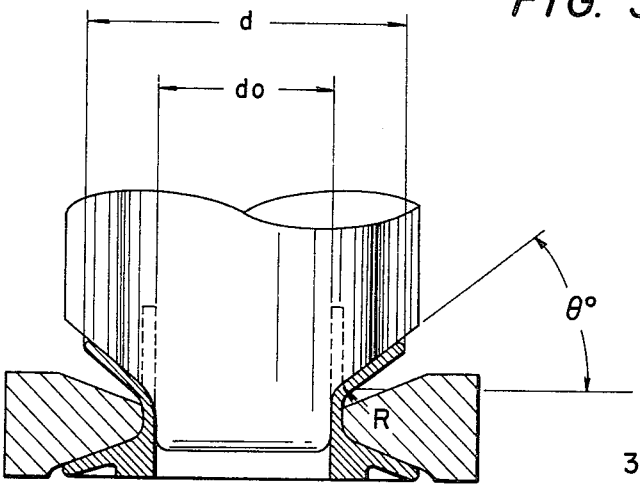
FIG. 3 is a partial cross-sectional view illustrated a relationship between an expanding ratio and an expanding angle.
Figure 4:
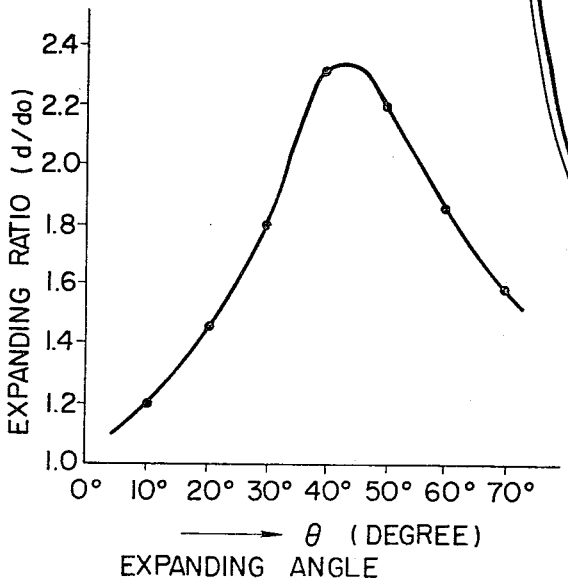
FIG. 4 is a graph showing an experimental result obtained according to the present invention with relation to the expanding ratio and the expanding angle.

FIGS. 3 and 4 provide an illustration of the relationship between an expanding ratio of an outer diameter d of the tubular thin wall portion 350 to an inner diameter $d_O$ thereof and an expanding angle $\theta$ in degrees, made between the second side portion 342 of the V-grooved pulley assembly 34 and the horizontal axis.

Figure 5:
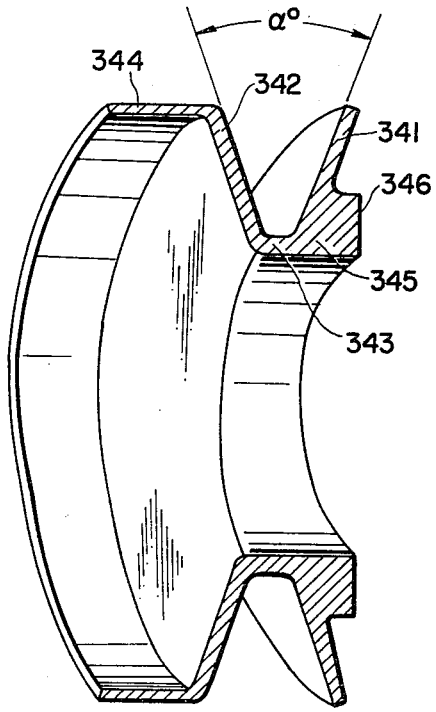
FIG. 5 is a partial cross sectional perspective view of the V-grooved pulley assembly fabricated according to the present invention.

As apparent from FIG. 4, wherein the ordinate represents the expanding ratio ($d/d_0$) and the abscissa represents the expanding angle $\theta$, the preferable expanding ratio is obtained when the tubular thin wall portion 350 is outwardly expended at an expanding angle of between 35° and 50°, whereby high efficient V-groove formation and uniform thickness of the thin wall portion are obtained with simplicity. An angle $\alpha$ between the first and the second side portions 341 and 342 of the V-grooved pulley assembly 34 is adjusted by the force added to the die ring 66 and is preferably between 32° and 36° as shown in FIG. 5.

A V-grooved pulley assembly having thick wall portion and thin wall portions therein is obtained in accordance with the present invention by cold working without machining, whereby the cost of material and labor is reduced, the integrity of the structure is improved, the weight of the V-grooved pulley assembly is reduced, and the number of steps for forming the V-grooved pulley assembly is decreased.

We claim:

1. A method of making a V-grooved pulley assembly, the method comprising the steps of:

forming a thick wall portion including one side wall portion of the assembly and a tubular thin wall portion which extends from said thick wall portion and includes the other side wall portion of the assembly from a tubular member by means of cold-working, and expanding said tubular thin wall portion so as to form a V-groove of the pulley assembly.

2. The method as set forth in claim 1, further comprising the step of forming a cylindrical portion extending from the other side wall portion of the pulley assembly.

3. A method of making a V-grooved pulley assembly, the method comprising the steps of:

forming a thick wall portion comprising a disc portion, a thin wall portion comprising one side wall portion of the assembly and a tubular thin wall portion which extends from the thick wall portion and includes the other side wall portion of the pulley assembly from a tubular member of metal by a process of forward extruding, and expanding said tubular thin wall portion so as that the other side wall portion and a bottom wall portion of the pulley assembly are formed.

4. The method as set forth in claim 3, further comprising the step of press forming a cylindrical portion extending from the other side wall portion of the pulley assembly.

5. The method as set forth in claim 3, wherein the step of expanding is carried out so that an expanding angle between the expanded tubular thin wall portion including the other side wall portion of the pulley assembly and a horizontal axis is between about 35° and 50°.

6. The method as set forth in claim 4, wherein the press forming is carried out sto that a V-groove angle $\alpha$ between the one side wall portion and the other side wall portion of the pulley assembly is between about 32° and 36°.

7. A method of making a V-grooved pulley assembly, the method comprising the steps of:

forming a thick disc-shaped wall portion having a friction end face, a thin first side wall portion extending the thick disc-shaped wall portion with a predetermined angle and a tubular thin wall portion which extends from the thick disc-shaped wall portion and includes a thin second side wall portion therein of the pulley assembly from a tubular member made of soft iron by a process of forward extruding, expanding said tubular thin wall portion so that the thin second side wall portion and a bottom wall portion of the pulley assembly are formed, and press forming a cylindrical portion extending from the thin second side wall portion of the pulley assembly.

* * * * *